United States Patent [19]

Hollis et al.

[11] 4,104,695

[45] Aug. 1, 1978

[54] STATIC ELECTRICITY DISCHARGE RING

[76] Inventors: Wanda L. Hollis; Darrell E. Hollis, both of 637 High Point Dr., Ventura, Calif. 93003

[21] Appl. No.: 763,034

[22] Filed: Jan. 27, 1977

[51] Int. Cl.[2] ..... H05F 3/00

[52] U.S. Cl. ..... 361/220

[58] Field of Search ..... 361/212, 220

[56] References Cited

U.S. PATENT DOCUMENTS 3,745,412 7/1973 Ruff ..... 361/220

*Primary Examiner*—Harry E. Moose, Jr.

*Attorney, Agent, or Firm*—Darrell E. Hollis

[57] ABSTRACT

A static electricity discharge ring comprising an adjustable metal band to which one lead of a gaseous discharge tube is connected. The metallic band is adapted to abut the human body. The other lead of the tube is connected to an elliptically-shaped electrode. The physical integrity of the discharge tube and the elliptically-shaped electrode are insured by a circular housing attached to the adjustable band. A human being having built up a charge of static electricity can discharge through the neon discharge tube to ground.

23 Claims, 9 Drawing Figures

STATIC ELECTRICITY DISCHARGE RING

BACKGROUND OF THE INVENTION

1. Field of the Invention

This invention relates generally to discharge devices and more particularly to a static-electricity discharge device for discharging the static electricity from a human body.

2. Description of the Prior Art

As is well known in the art, the human body is capable of accumulating a charge of electricity commonly known as static electricity. This charge of static electricity can be dramatically illustrated by running a comb through human hair on a cold morning and listening to the "crackle" of the static electricity. A very painful illustration of this static electricity build up phenomenon which has been experienced by almost all human beings is the discharge of static electricity through the fingertips to a doorknob after crossing a carpeted room. Even more embarrassing than painful is the discharge of static elctricity through the fingertips of one human being to the hand or other extremeties of a second human being.

In addition to being extremely painful upon discharge, static electricity build up in a human being can be extremely dangerous. Once a static electricity charge builds up in a human being, he may not discharge for an extended period of time. During this time period, he may enter an explosive environment where he may inadvertently discharge creating a spark resulting in an explosion.

SUMMARY OF THE INVENTION

The general purposes of the present invention are to reduce the pain and danger attendant upon the discharge of static electricity from human beings as well as serving as a visual indicator to a human that he has discharged his built up charge of static electricity. To attain this, the present invention provides a static electricity discharge device comprising an adjustable metal band to which one lead of a discharge device is connected. The metallic band is adapted to abut the human body. The other lead of the discharge device is connected to an elliptically-shaped electrode. The physical integrity of the discharge device and the elliptically-shaped electrode are maintained by a housing attached to the adjustable band. A human being having built up a charge of static electricity can discharge through a path to ground including the adjustable band to the discharge device, and the elliptically-shaped electrode. During discharge the discharge device provides a visual indication of the static electricity passing out of the body to ground. As disclosed in detail, infra, several additional embodiments are included in the present invention.

Accordingly, one object of the present invention is to reduce pain.

Another object of the present invention is to provide a visual indication of static electricity discharge.

A still further object of the present invention is to provide a small, inexpensive, durable and reliable static electricity discharge device.

One other object of the present invention is to provide a static electricity discharge device.

A still further object of the present invention is to reduce danger.

Other objects and a more complete appreciation of the present invention and its many attendant advantages will develop as the same becomes better understood by reference to the following detailed description when considered in connection with the accompanying drawings in which like reference numerals designate like parts throughout the figures thereof and wherein.

DESCRIPTION OF THE PREFERRED EMBODIMENT

Figure 1A:
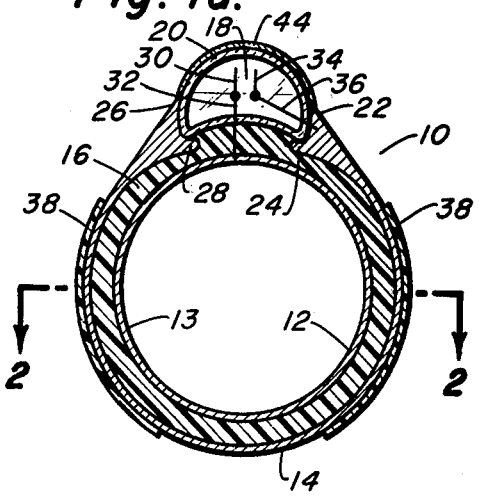
FIGS. 1*a* and 1*b* illustrate one embodiment of the present invention.
Figure 1B:
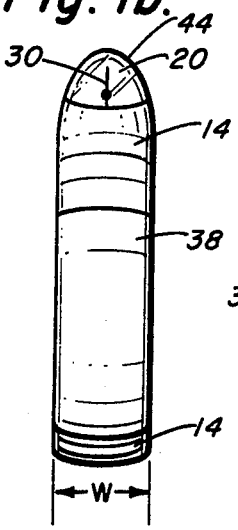

Turning to FIGS. 1*a* and 1*b*, a static electricity discharge ring 10 is illustrated. Ring 10 includes an inner ring member 12 and an outer ring member 14. Both ring members 12 and 14 are fabricated from an electrically conductive material such as aluminum, steel, gold, silver, or other such suitable metals as may be desired. Inside diameter surface 13 is adapted to abut the human body, preferably about the finger or wrist.

An electrically insulating ring member 16 is sandwiched between ring members 12 and 14 such that ring member 12 is electrically insulated from ring member 14. Ring member 16 is fabricated from any suitable electrical insulating material.

Ring member 14 contains an opening 18 within which neon gas discharge tube 20 is disposed. Fingers 22, 24, 26 and 28 of ring member 14 affix neon tube 20 to ring member 14 and insulation ring or layer 16. It is noted that an adhesive may be employed to rigidly affix neon tube 20 to ring member 14 and insulation ring 16.

Electrode 30 of neon tube 20 is electrically connected to ring member 12 via line 32 while electrode 34 is connected to ring member 14 via line 36.

Electrically insulating layers 38 are rigidly affixed to ring member 14. Layers 38 prevent ring member 14 from shorting to adjacent fingers of the human body when ring 10 is disposed on a finger.

FIG. 1*b* is a side view of discharge ring 10 illustrating the width *w* of discharge ring 10.

Figure 2:
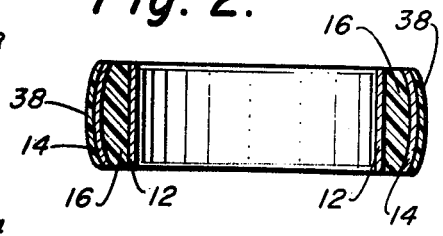
FIG. 2 is a cross-sectional view of the embodiment of FIG. 1*a* taken along 2—2.

FIG. 2 is a cross-sectional view taken along line 2—2 of FIG. 1.

Now turning to FIG. 4 in conjunction with FIG. 1, the operation of static electricity discharge ring 10 is as follows. Inner ring 12 is adapted to abut the human body preferably about a finger or wrist. The human body, when charged up with static electricity, is equivalent to d.c. battery source 40. By closing switch 42, a d.c. voltage will appear across neon discharge tube 20. Closing switch 42 is analogous to grounding ring member 14, e.g., to a metallic door knob. If the d.c. voltage is large enough, neon tube 20 will discharge, emitting a light. Static electricity discharge ring 10 operates in the same manner. When the wearer touches or grounds outer ring 14 to a ground, such as a door knob, the static d.c. voltage charge stored in the body of the wearer will discharge from ring member 12 through neon tube 20 to ring member 14 which is grounded. The discharge causes neon tube 20 to emit a flash of light.

Covering neon tube 20 is translucent layer 44 which may be color tinted to provide a specific colored flash. Electrical insulating layer 38 prevents ring member 14 from shorting to the body of the wearer during discharge.

It is noted that the surface area of inside diameter surface 13 abutting the body during discharge of the electrical charge traversing from the body of the wearer to ring member 12 determines the degree of perception of electrical shock the wearer experiences. In general, the larger the surface area of surface 13, the smaller the amount of static electricity discharging through a unit area of skin. Assuming an equal number of nerve endings per unit area of skin abutting surface 13, the larger surface 13, the smaller the perception of electrical shock experienced by a wearer.

In addition, discharge ring 10 is designed for wear on the fingers or wrist where the skin areas contain fewer nerve endings per unit skin area than do the fingertips. Thus, discharging the body through ring 10 about the fingers or wrist reduces the perception of electrical shock to a wearer. It is assumed that a great majority of persons would discharge themselves through their fingertips which contain a high concentration of nerve endings.

Figure 3:
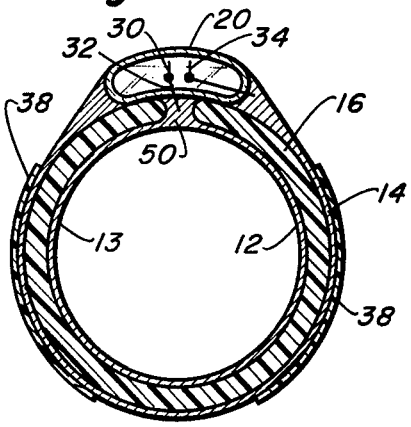
FIG. 3 illustrates an embodiment of the present invention.

FIG. 3 illustrates another embodiment of the present invention. A metallic projection 50 extends upwards from ring member 12 through insulating ring 16 to provide electrical connection to electrode 30 via line 32. It is noted that ring members 12 and 14 and insulating ring 16 are bonded together with adhesive or other means such that they do not move with respect to each other. Projection 50 facilitates this providing a physical barrier to movement between ring member 12 and insulating layer 16.

Figure 5:
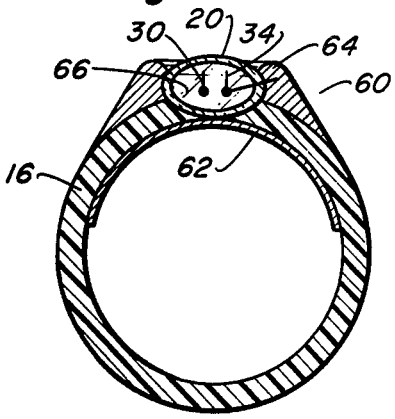
FIG. 5 illustrates an embodiment of the present invention.

FIG. 5 illustrates another embodiment of the present invention — static discharge ring 60. Ring 60 includes electrically insulating ring 16, metallic layer 62 and metallic ring 64. Neon tube 20 is disposed in opening 66 with electrode 30 connected to metallic layer 62 and electrode 34 connected to metallic ring 64. Discharge ring 60 discharges static electricity from the body of a wearer from metallic layer 62 through neon discharge tube 20 to metallic ring 64 which is grounded.

Figure 4:
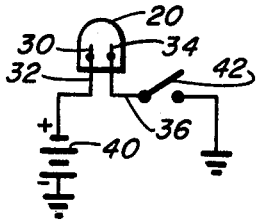
FIG. 4 is a schematic of the circuit for the embodiments of FIGS. 1, 3, 5 and 6.

It is noted that the schematic circuit representation of FIG. 4 describes the electrical circuits of the embodiments of FIGS. 1*b*, 3, 5 and 6.

Figure 6:
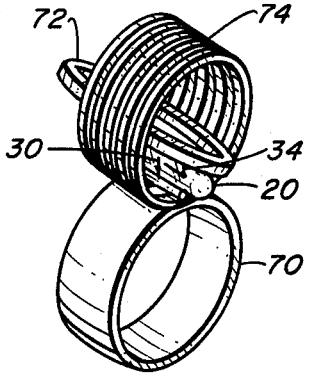
FIG. 6 illustrates an embodiment of the present invention.
Figure 7:
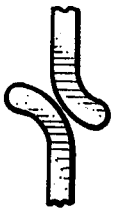
FIG. 7 illustrates an adjustable ring.
Figure 8:
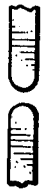
FIG. 8 illustrates an adjustable ring.

FIGS. 7 and 8 illustrate an adjustable feature that may be utilized on the embodiments illustrated in FIGS. 1*b*, 3, 5 or 6.

FIG. 6 illustrates still another embodiment of the present invention. Neon discharge tube 20 is electrically connected between ring member 70 and oval-shaped member 72. A plane defined by oval-shaped member 72 is disposed substantially perpendicular to a plane defined by ring member 70 and substantially parallel to an axis substantially perpendicular to the plane of ring member 70 and passing through the center of ring member 70. It is noted that the physical placement of oval-shaped member 72 with respect to ring member 70 need not be as described above for proper operation. Oval-shaped member 72 may be disposed with respect to ring member 70 in any position whereby a wearer may ground oval-shaped member 72. It is noted that ring member 70 is adapted to abut the skin of the human body.

The operation of the embodiment of FIG. 6 is as follows. When oval-shaped member 72 is grounded, the built-up static electrical charge in the body of the ring wearer discharges to ground through ring member 70, neon discharge tube 20 and oval-shaped member 72. During discharge, neon discharge tube 20 emits a flash of light, thereby indicating to the wearer that his body has discharged. Housing 74 encircles oval shaped member 72 and discharge tube 20 and attaches to ring member 70. Housing 74 ensures the physical integrity of oval-shaped member 72 and discharge tube 20.

It is noted that gaseous discharge tube 20 is specified as a neon tube. However, it is noted that various other gases may be utilized such as argon, among others. Different gases emit different color light upon discharge. The breakdown voltage for gaseous discharge tube 20 is in a range of approximately 25 to 200 d.c. volts.

Obviously numerous modifications and variations of the present invention are possible in light of the above teachings. It is therefore to be understood that within the scope of the appended claims the invention may be practiced otherwise than as specifically described herein.

What is claimed is:

1. A static electricity discharge ring for discharging static electricity from a human body comprising:

a. a first substantially ring-shaped electrically conductive member having an inside surface adapted to abut the human body, said inside surface providing a reduction in the shock perceptible to a human body during discharge of static electricity accumulated in the human body by reducing the amount of static electricity discharging through a unit area of skin;

b. a second substantially ring-shaped electrically conductive member spaced from said first member; and c. discharge indication means electrically interconnected between said first member and said second member for providing an indication of the discharge of static electricity accumulated in the human body when said second member is grounded, said static electricity traversing a path from the human body through said first member, then through said discharge means, then through said second member to ground.

2. The apparatus of claim 1 wherein said inside surface is of sufficient area to eliminate the shock perceptible to a human body during discharge of static electricity therefrom.

3. The apparatus of claim 1 further comprising means disposed on portions of the exterior of said second ring-shaped member for preventing a short-circuit between said first and second ring-shaped members through the body of a wearer.

4. The apparatus of claim 1 further comprising electrical insulating means disposed in annular relationship between said first and second ring-shaped members for providing electrical insulation therebetween.

5. The apparatus of claim 4 wherein said second ring-shaped member has an opening therein exposing said insulating means, said discharge indicator means being disposed in said opening such that said discharge indicator means is rigidly held in place between said second ring-shaped member and said insulating means.

6. The apparatus of claim 5 further comprising electrical interconnection means extending through said insulating means from said opening to electrically interconnect with said first ring-shaped member.

7. The apparatus of claim 1 further comprising means disposed between said first member and said second member for electrically insulating said first member from said second member.

8. The apparatus of claim 1 further comprising means for rigidly affixing said discharge indicator means to said second member.

9. The apparatus of claim 1 wherein said second ring-shaped member is substantially oval-shaped with a plane defined by said oval-shaped member being substantially parallel to a plane defined by said first ring-shaped member, thereby facilitating the grounding of said second ring-shaped member.

10. The apparatus of claim 9 further comprising a housing rigidly affixed to said first ring-shaped member and encircling said discharge indicator means and said second ring-shaped member for ensuring the physical integrity of the same.

11. The apparatus of claim 1 wherein said discharge indication means includes visual discharge indication means providing a visual indication of said discharge.

12. The apparatus of claim 11 further comprising means disposed adjacent said visual discharge indicator means for providing a visual indication of said discharge exhibiting a specific coloration.

13. The apparatus of claim 1 wherein said visual discharge indicator means includes a gaseous discharge tube.

14. The apparatus of claim 13 wherein said discharge tube includes a neon discharge tube.

15. A static electricity discharge ring for discharging static electricity from a human body comprising:

a. a substantially ring-shaped electrically-insulating member having an inside diameter surface and an outside diameter surface;

b. a first electrically-conductive member disposed in abutting relationship to said inside diameter surface, said first member being adapted to abut the human body for providing a reduction in the shock perceptible to a human body during discharge of static electricity accumulated in the human body;

c. a second electrically-conductive member disposed in abutting relationship to said outside diameter surface; and d. discharge indication means electrically interconected between said first member and said second member for providing an indication of the discharge of static electricity accumulated in the human body when said second member is grounded, said static electricity traversing a path from the human body through said first member, then through said discharge means, then through said second member to ground.

16. The apparatus of claim 15 wherein said second electrically-conductive member is ring-shaped.

17. The apparatus of claim 16 wherein said electrically-insulating member contains an opening therein within which said discharge indicator means is disposed.

18. The apparatus of claim 17 wherein said second member is disposed adjacent the circumference of said opening.

19. The apparatus of claim 15 wherein said discharge indicator means includes visual discharge indicator means providing a visual indication of said discharge.

20. The apparatus of claim 19 further comprising means disposed adjacent said discharge indicator means for providing a visual indication exhibiting a specific coloration.

21. The apparatus of claim 19 wherein said visual discharge means includes a gaseous discharge tube.

22. The apparatus of claim 21 wherein said discharge tube includes a neon discharge tube.

23. The apparatus of claim 15 wherein said first electrically conductive member contains sufficient area abutting the human body to eliminate the shock perceptible to a human body during discharge of static electricity therefrom.

* * * * *